United States Patent [19]

Ishikawa et al.

[11] Patent Number: 4,491,630

[45] Date of Patent: Jan. 1, 1985

[54] SILVER HALIDE COLOR PHOTOGRAPHIC LIGHT-SENSITIVE MATERIAL

[75] Inventors: Takatoshi Ishikawa; Akio Mitsui; Masakazu Morigaki; Takashi Nakamura, all of Kanagawa, Japan

[73] Assignee: Fuji Photo Film Co., Ltd., Kanawaga, Japan

[21] Appl. No.: 460,512

[22] Filed: Jan. 24, 1983

[30] Foreign Application Priority Data

Jan. 25, 1982 [JP] Japan ..... 57/9831

[51] Int. Cl.[3] ..... G03C 7/16

[52] U.S. Cl. ..... 430/372; 430/387; 430/551; 430/555

[58] Field of Search ..... 430/372, 387, 551, 555

[56] References Cited

U.S. PATENT DOCUMENTS

| | | | |
|---|---|---|---|
| 4,310,623 | 1/1982 | Watanabe et al. | 430/551 |
| 4,351,897 | 9/1982 | Aoki et al. | 430/555 |
| 4,383,027 | 5/1983 | Ishikawa et al. | 430/551 |
| 4,385,111 | 5/1983 | Nakamura et al. | 430/555 |

*Primary Examiner*—J. Travis Brown

*Attorney, Agent, or Firm*—Sughrue, Mion, Zinn, Macpeak & Seas

[57] ABSTRACT

A silver halide color photographic light-sensitive material comprising a support having thereon a silver halide emulsion layer containing at least one kind of compound represented by the following general formula (I):

(I)

wherein each substituent represented by $R_1$, $R_2$, $R_3$, X, or Ar and m are defined within the specification, said silver halide color photographic light-sensitive material comprises a compound represented by the following general formula (II) in the silver halide emulsion layer containing the compound represented by the above general formula (I) and/or a hydrophilic colloid layer which is positioned at the remoter side than the silver halide emulsion layer from the support:

(II)

wherein each substituent represented by Y, $R_4$, $R_5$, $R_6$, $R_7$ or Ar is defined within the specification.

The silver halide color photographic light-sensitive material can provide a magenta color image having excellent photographic properties without the occurrence of stain, even when the color photographic material is processed in a processing solution under the running condition.

A method of forming a color image using the silver halide color photographic light-sensitive material is also disclosed.

23 Claims, No Drawings

SILVER HALIDE COLOR PHOTOGRAPHIC LIGHT-SENSITIVE MATERIAL

FIELD OF THE INVENTION

The present invention relates to a color photographic light-sensitive material containing a 2-equivalent magenta coupler and, particularly, to a method for prevention of stain which occurs during development processing of a color photographic light-sensitive material containing a 2-equivalent magenta coupler.

BACKGROUND OF THE INVENTION

Various pyrazolone derivatives are known as a magenta dye forming coupler (hereinafter referred to as a magenta coupler). However, pyrazolone derivatives generally used for photographic light-sensitive materials are 4-equivalent couplers. Such compounds theoretically require the development of 4 moles of silver halide for forming 1 mole of a dye by reacting with an aromatic primary amine developing agent. On the contrary, pyrazolones having an active methylene group substituted by a group which can be released by oxidative coupling with an oxidation product of the primary amine developing agent require development of only two moles of silver halide. In addition, the 4-equivalent pyrazolone derivatives have a low color forming efficiency (conversion of the coupler into the dye) and form generally only a ½ mole or so of the dye per mole of the coupler.

As a means for improving the color forming efficiency by decreasing the amount of silver halide required for development, utilization of 2-equivalent pyrazolone magenta couplers has been proposed. Examples of pyrazolone derivatives which release an oxygen atom include compounds having an aryloxy group in the 4-position of 5-pyrazolone as described in U.S. Pat. No. 3,419,391 and compounds having an acyloxy group as described in U.S. Pat. Nos. 3,311,476 and 3,926,631.

Examples of pyrazolone derivatives which release a nitrogen atom include compounds having an imidazolyl group, a pyrazolyl group or a triazolyl group in the 4-position of 5-pyrazolone as described in U.S. Pat. Nos. 4,076,533 and 4,241,168.

Further, examples of pyrazolone derivatives which release a sulfur atom include compounds having a heterocyclic thio group or an arylthio group in the 4-position of 5-pyrazolone as described in U.S. Pat. No. 3,227,554, compounds having a thiocyano group in the 4-position of 5-pyrazolone as described in U.S. Pat. No. 3,214,437 and compounds having a dithiocarbamate group in the 4-position of 5-pyrazolone as described in U.S. Pat. No. 4,032,346. These compounds are advantageous in that most of them can be synthesized from 4-equivalent pyrazolones by one step. Also, these compounds are advantageous in view of photographic sensitivity and equivalency. It has been found that compounds having a 2-alkoxyarylthio group in the 4-position of 5-pyrazolone have exceptionally superior properties among couplers of type which release an arylthio group. More specifically, these compounds are described in U.S. Pat. No. 4,351,897. In addition, magenta color images formed from the couplers having a 2-alkoxyarylthio group have good fastness to light, while the light fastness of magenta color images formed from conventional couplers having an arylthio group is remarkably inferior.

However, with these 2-equivalent magenta couplers, a disadvantageous property whereby stains (increase in color density in unexposed areas) are formed by development processing is eliminated to a certain extent but the elimination is still insufficient.

The stains occurring in unexposed areas of silver halide color photographic light-sensitive material are undesirable since they are the definite factor in determining whether the whiteness of the non-image areas is good or bad. Further, the stains adversely affect the color turbidity of the images and injure their visual sharpness. Particularly, in case of reflective photographic materials, for example, photographic color papers, the reflective density of the stains is theoretically emphasized so that it becomes several times as high as the transmission density. Therefore, the stains are very important factors since a slight degree of stain can injure image quality.

The stains in the silver halide color photographic light-sensitive materials are roughly classified to four groups depending on the cause of the stain occurrence. First is a stain which is formed after the production of the photographic light-sensitive material and before the processing thereof due to heat or humidity. Second is a stain due to a development fog of silver halide. Third is a stain based on color contamination due to color couplers in a development processing solution (for example, aerial fog, etc.) or a stain due to a dye formed by the reaction with coupler of an oxidized developing agent which is formed by oxidation of a developing agent remaining in the silver halide emulsion layer by a bleach solution or oxygen in the air, etc., (for example, bleaching stain, etc.). And fourth is a stain based on changes in photographic materials after development processing with the passage of time due to light, humidity or heat. The stains due to the development processing of the photographic materials containing 2-equivalent magenta couples according to the present invention relate to the third and fourth stains described above.

A more difficult problem is that it is unusual to newly prepare a solution for the development processing before every development processing. In practice, the solution is employed by replenishing a developing solution in an amount depending on an amount of photographic materials developed. However, a composition of the solution cannot be maintained only by the replenishment of the components which are consumed by development.

In general, a solution for development processing includes a color developing solution, a stopping solution, a bleaching solution, a fixing solution or a bleach-fixing (blixing) solution, etc. Since the processing temperature is maintained at a high temperature such as from 31° C. to 43° C., the compositions of the processing solutions are changed by several factors such that the developing agent, etc., is subjected to decomposition for a long period of time or to oxidation when brought in contact with the air, that the components contained in the photographic light-sensitive materials are dissolved out and accumulated in the solution during the processing of the photographic light-sensitive materials, and that a processing solution is taken into the following bath by attaching with the photographic material. Thus, the processing solution becomes the so-called running solution. To eliminate such problems, a replenishment procedure in which chemicals lacked are supplementarily added to the solution and a regeneration procedure in which desirable components are removed are carried out. However, such procedures are still incomplete.

The photographic light-sensitive materials containing 2-equivalent magenta couplers have a large tendency to form stains in the running solution. However, the occurrence of such stains cannot be prevented by techniques heretofore known. A known method for preventing such stains involves the incorporation of a reducing agent, particularly, an alkylhydroquinone (for example, those as described in U.S. Pat. Nos. 3,935,016 and 3,960,570) into a photographic light-sensitive material, particularly, an emulsion layer wherein the stains are formed is effective. It is also known that a chroman, a coumaran (for example, those as described in U.S. Pat. No. 2,360,292), a phenol type compound (for example, those as described in Japanese Patent Application (OPI) No. 9949/76 (the term "OPI" as used herein refers to a "published unexamined Japanese patent application")), etc., are effective. Furthermore, a sulfinic acid type polymer is known as being effective as described in U.S. Pat. No. 4,352,873. However, these known techniques cannot provide sufficiently good effects against the processing stain due to 2-equivalent magenta couplers, in particular, the processing stain owing to the exhausted solution, while a little effect is recognized.

SUMMARY OF THE INVENTION

An object of the present invention is to provide a method for preventing the occurrence of stain when a photographic light-sensitive material containing a 2-equivalent magenta coupler is subjected to development processing, and particularly, a method for completely preventing the occurrence of stain in a solution for development processing under the running condition.

Another object of the present invention is to provide a photographic light-sensitive material in which a 2-equivalent magenta coupler is used and an amount of silver contained is reduced and which has good sharpness and an excellent property of development processing.

Other objects of the present invention will become apparent from the following detailed description and examples.

The above-described objects of the present invention can be attained by a silver halide color photographic light-sensitive material comprising a support having thereon a silver halide emulsion layer containing at least one kind of compound represented by the following general formula (I):

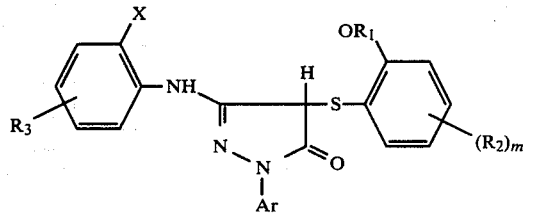

(I)

wherein $R_1$ represents an alkyl group or an aryl group; $R_2$ represents hydrogen, a hydroxy group, a halogen atom, an alkyl group, an alkoxy group or an aryl group; $R_3$ represents hydrogen, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, or a trichloromethyl group; X represents a halogen atom or an alkoxy group; Ar represents a substituted phenyl group; m is an integer of from 1 to 4; said silver halide color photographic light-sensitive material comprises at least one kind of compound represented by the following general formula (II) in the silver halide emulsion layer containing at least one kind of compound represented by the above general formula (I) and/or a hydrophilic colloid layer which is positioned at the remoter side than said silver halide emulsion layer from the support;

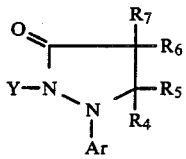

(II)

wherein Ar represents a phenyl group; Y represents hydrogen or an acyl group; $R_4$, $R_5$, $R_6$ and $R_7$, which may be the same or different, each represents an alkyl group, an alkoxy group, an aryl group, an alkylthio group or an arylthio group; and the total number of carbon atoms included in the substituents represented by $R_4$, $R_5$, $R_6$ and $R_7$ and the substituents on the phenyl group represented by Ar is not less than 6.

DETAILED DESCRIPTION OF THE INVENTION

The magenta couplers of the general formula (I) used in the present invention are described in more detail below.

In the general formula (I), Ar is a substituted phenyl group. The examples of substituents for the phenyl group including a halogen atom (for example, chlorine, bromine, fluorine, etc.), an alkyl group having from 1 to 22 carbon atoms (for example, a methyl group, an ethyl group, a tetradecyl group, a tert-butyl group, etc.), an alkoxy group having from 1 to 22 carbon atoms (for example, a methoxy group, an ethoxy group, an octyloxy group, a dodecyloxy group, etc.), an alkoxy-carbonyl group having from 2 to 23 carbon atoms (for example, a methoxycarbonyl group, an ethoxycarbonyl group, a tetradecyloxycarbonyl group, etc.), or a cyano group. The particularly preferred example of substituent for the phenyl group includes a halogen atom.

X in the general formula (I) represents a halogen atom (for example, chlorine, bromine, fluorine, etc.) or an alkoxy group having from 1 to 22 carbon atoms (for example, a methoxy group, an octyloxy group, a dodecyloxy group, etc.). The particularly preferred example of X includes a halogen atom.

$R_3$ in the general formula (I) represents hydrogen, a halogen atom (for example, chlorine, bromine, fluorine, etc.), a straight chain or branched chain alkyl group (for example, a methyl group, a tert-butyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, a tetradecanamido group, an α-(2,4-di-tert-amylphenoxy)acetamido group, an α-(2,4-di-tert-amylphenoxy)butyramido gorup, an α-(3-pentadecylphenoxy)hexanamido group, an α-(4-hydroxy-3-tert-butylphenoxy)tetradecanamido group, a 2-oxopyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (for example, an N-methylsulfamoyl group, an N-hexadecylsulfamoyl group, an N-[3-(dodecyloxy)propyl]-sulfamoyl group, an N-[4-(2,4-di-tert-amylphenoxy)-butyl]sulfamoyl group, an N-methyl-N-tetradecylsulfamoyl group, etc.), a carbamoyl group (for example, an N-metylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, a N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, an octyloxysulfonyl group, a tetradecyloxysulfonyl group, etc.), an aryloxysulfonyl group (for example, a phenoxysulfonyl group, a 2,4-di-tert-amylphenoxysulfonyl group, etc.), an alkanesulfonyl group (for example, a methanesulfonyl group, an octanesulfonyl group, a 2-ethylhexanesulfonyl group, a hexadecanesulfonyl group, etc.), an arylsulfonyl group (for example, a benzenesulfonyl group, a 4-nonylbenzenesulfonyl group, etc.), an alkylthio group (for example, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, an ethyloxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group or a trichloromethyl group. In the above-described substituents, the alkyl moieties thereof preferably have from 1 to 36 carbon atoms, and the aryl moieties thereof preferably have from 6 to 38 carbon atoms. The particularly preferred examples of $R_3$ include an acylamino group.

$R_1$ in the general formula (I) represents an alkyl group, preferably having from 1 to 22 carbon atoms (for example, a methyl group, a propyl group, a butyl group, a 2-methoxyethyl group, a methoxymethyl group, a hexyl group, a 2-ethylhexyl group, a dodecyl group, a hexadecyl group, a 2-(2,4-di-tert-amylphenoxy)ethyl group, a 2-dodecyloxyethyl group, etc.) or an aryl group (for example, a phenyl group, an $\alpha$- or $\beta$-naphthyl group, a 4-tolyl group, etc.).

$R_2$ in the general formula (I) represents hydrogen, a hydroxy group, or a halogen atom, an alkyl group, an alkoxy group, or an aryl group, each as defined for $R_3$ above.

Of the couplers represented by the general formula (I) those in which the total number of carbon atoms included in the groups represented by $R_1$ and $R_2$ is not less than 6 are particularly preferred for achieving the objects of the present invention.

Specific examples of the typical couplers according to the present invention are set forth below, but the present invention is not to be construed as being limited to these compounds.

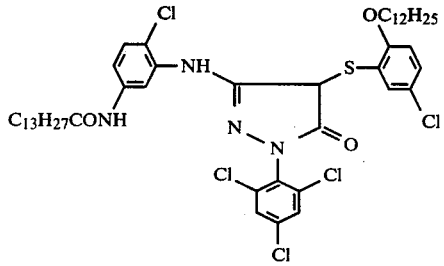

(I-1)

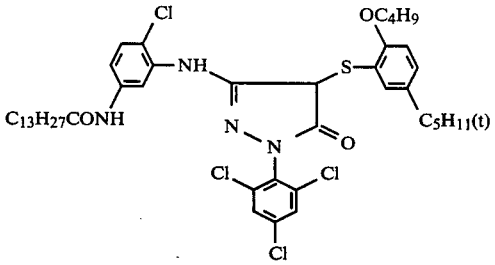

(I-2)

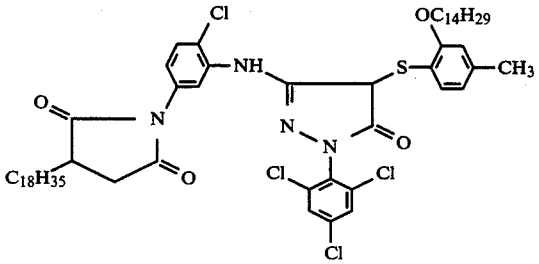

(I-3)

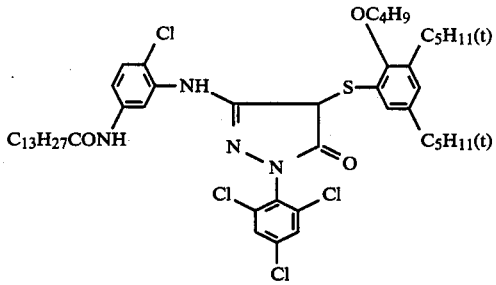

(I-4)

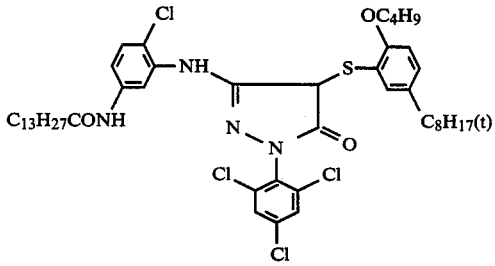

(I-5)

-continued
(I-6)
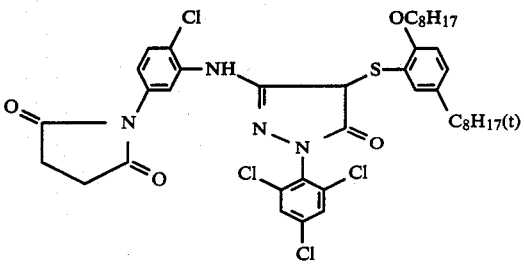
(I-7)
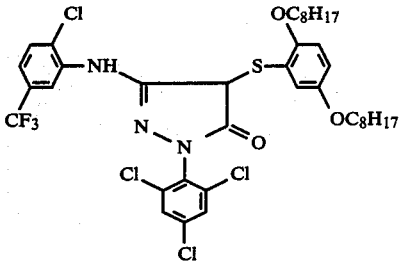
(I-8)
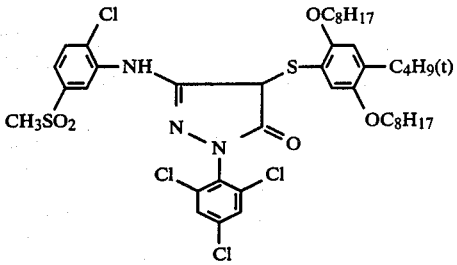
(I-9)
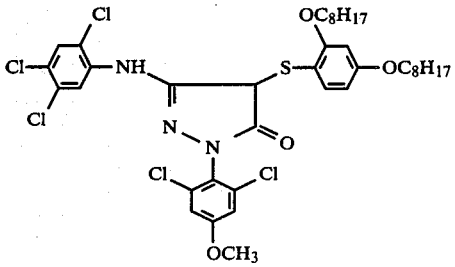
(I-10)
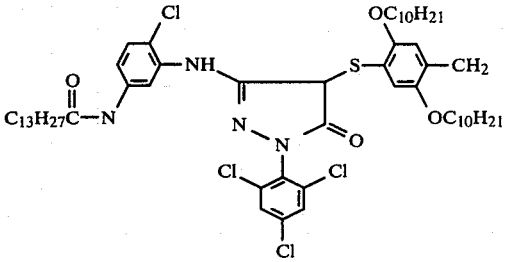
(I-11)
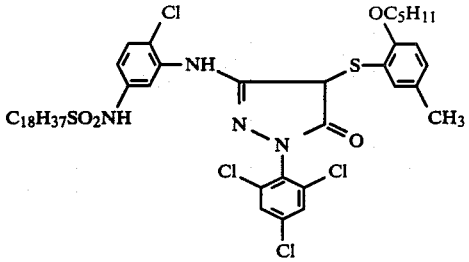
-continued
(I-12)
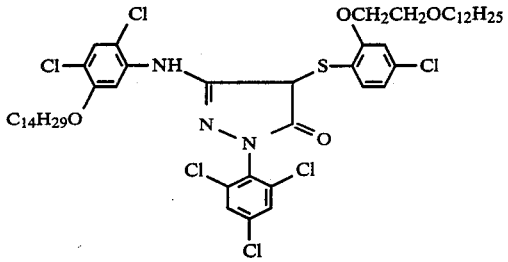
(I-13)
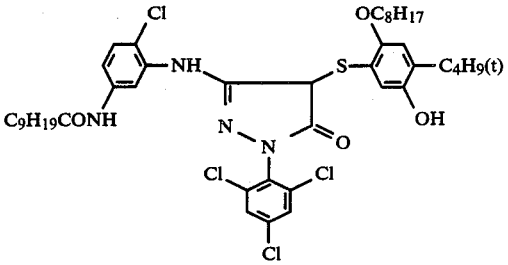
(I-14)
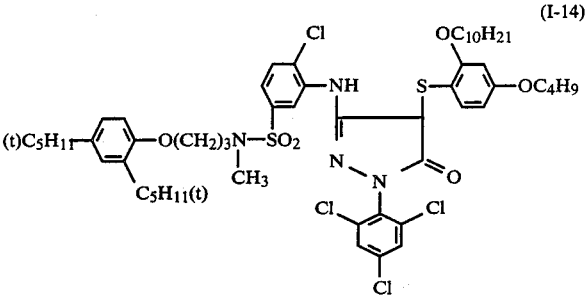
(I-15)
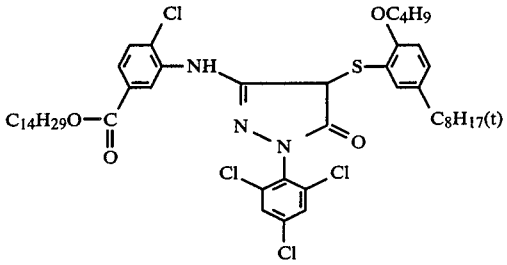
(I-16)
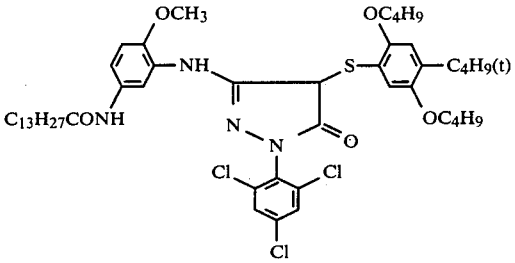
(I-17)
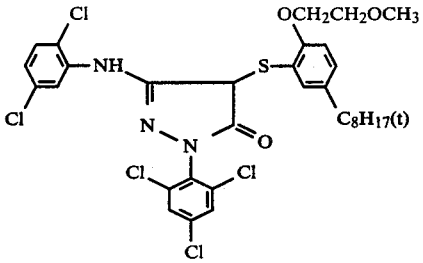

-continued
(I-18)
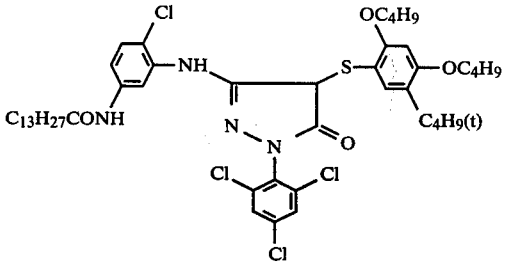
(I-19)
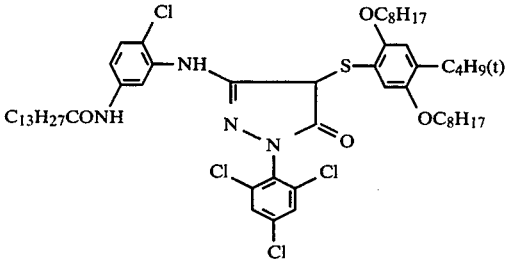
(I-20)
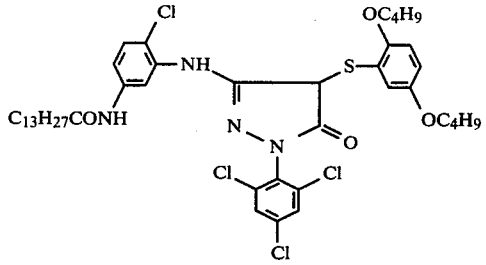
(I-21)
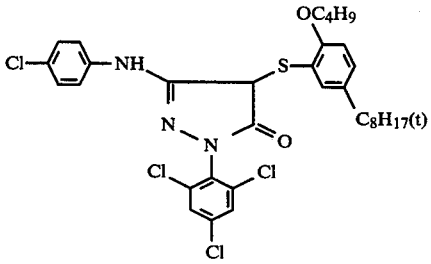
(I-22)
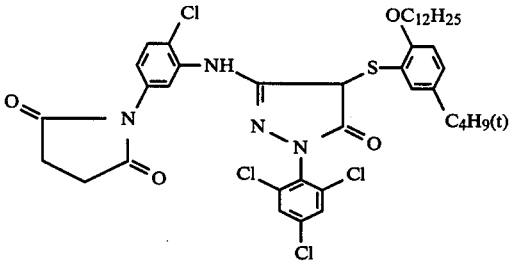
(I-23)
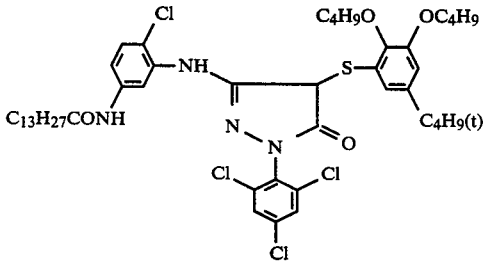
-continued
(I-24)
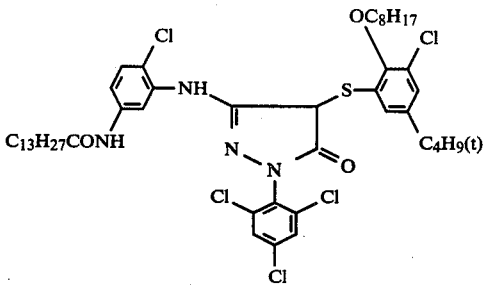
(I-25)
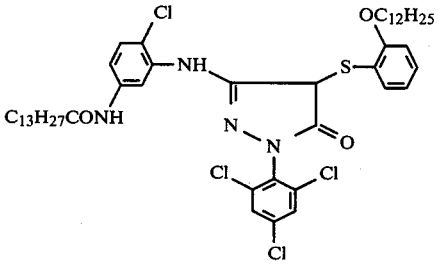
(I-26)
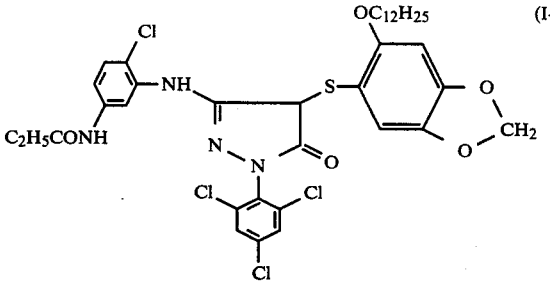
(I-27)
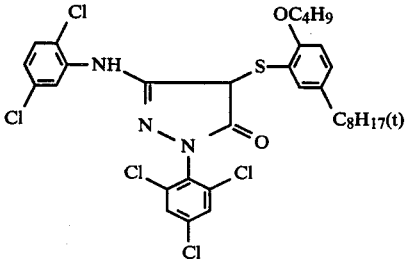
(I-28)
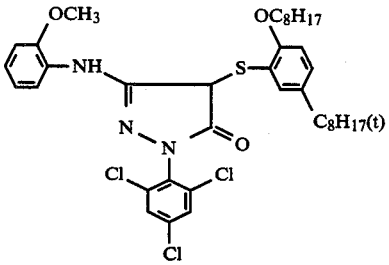
(I-29)
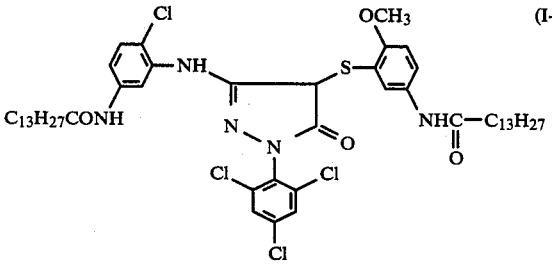

-continued

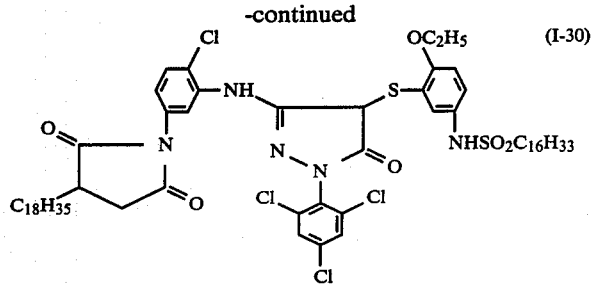

(I-30)

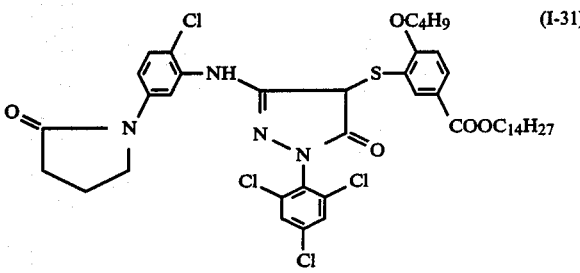

(I-31)

The preferred specific examples of the typical couplers according to the present invention include compounds represented by (I-1), (I-2), (I-3), (I-4), (I-5), (I-6), (I-10), (I-13), (I-16), (I-18), (I-19), (I-20), (I-23), (I-24) and (I-26). The particularly preferred specific examples of the typical couplers according to the present invention include compounds represented by (I-2), (I-4), (I-5), (I-6), (I-10), (I-13), (I-16), (I-19), (I-20), (I-23) and (I-24).

The magenta couplers which can be used in the present invention can be synthesized using a corresponding thiophenol derivative which forms a coupling releasable group and the so-called 4-equivalent coupler in which the coupling active position is not substituted by the method as described in U.S. Pat. No. 4,351,897.

The compounds represented by the general formula (II) are described in more detail below.

In the general formula (II), the phenyl group represented by Ar may be substituted. Examples of the substituents include a halogen atom (for example, chlorine, bromine, etc.), an amino group, a nitro group, an alkyl group, preferably having from 1 to 20 carbon atoms (for example, a methyl group, an ethyl group, a propyl group, a butyl group, etc.), an alkoxy group, preferably having from 1 to 20 carbon atoms (for example, a methoxy group, an ethoxy group, a butoxy group, etc.), and a carboxy group. These substituents may be further substituted with, for example, a halogen atom, an amino group, a nitro group, a sulfonyl group, a hydroxy group, an arylthio group, an alkylthio group, a carboxy group, etc.

Of these groups for Ar in the general formula (II), an unsubstituted phenyl group, an alkyl-substituted phenyl group and an alkoxy-substituted phenyl group are preferred.

The acyl group represented by Y in the general formula (II) is preferably an acyl group having from 1 to 5 carbon atoms, for example, a formyl group, an acetyl group, a propionyl group, a butyryl group, etc. Hydrogen and an acetyl group are preferred for Y.

The alkyl group, the alkoxy group and the alkylthio group represented by $R_4$, $R_5$, $R_6$ and $R_7$ in the general formula (II) are preferably those having from 1 to 20 carbon atoms. Specific examples of these groups include a methyl group, an ethyl group, a propyl group, a butyl group, a methoxy group, an ethoxy group, a methylthio group, an ethylthio group, a propylthio group, a butylthio group, etc.

The aryl group and the arylthio group represented by $R_4$, $R_5$, $R_6$ and $R_7$ in the general formula (II) are preferably those having from 6 to 18 carbon atoms. Specific examples of these groups include a phenyl group, a naphthyl group, a phenylthio group, a naphthylthio group, etc.

The alkyl group, the alkoxy group, the aryl group, the alkylthio group and the arylthio group represented by $R_4$, $R_5$, $R_6$ and $R_7$ described above may be substituted with one or more substituents. Examples of the substituents include a hydroxy group, a halogen atom (for example, chlorine, bromine, etc.), an amino group, a nitro group, an alkoxy group (preferably having from 1 to 20 carbon atoms), a carboxy group, a group of —O—X—$R_8$, etc. These groups may be further substituted. In the above formula —O—X—$R_8$, $R_8$ represents an alkyl group (preferably having from 1 to 18 carbon atoms), an alkenyl group (preferably having from 1 to 18 carbon atoms), a cycloalkyl group (for example, a cyclopentyl group, a cyclohexyl group, a cycloheptyl group, etc.), an aryl group (for example, a phenyl group, a substituted phenyl group, a naphthyl group, a substituted naphthyl group, etc.) or a heterocyclic group (for example, a heterocyclic group containing at least one of nitrogen, oxygen and sulfur, etc.). X represents —CO—, —OCO—, —OCOCO—, —$SO_2$— or —NHCO—.

In the general formula (II), the total number of carbon atoms included in the substituents represented by $R_4$, $R_5$, $R_6$ and $R_7$ and the substituents on the phenyl group represented by Ar is not less than 6, preferably from 6 to 50 and more preferably from 8 to 30.

Specific examples of the compounds represented by the general formula (II) are set forth below, but the present invention is not to be construed as being limited to these compounds.

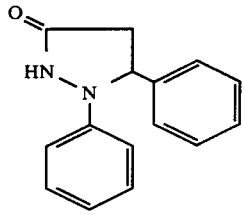

(II-1)

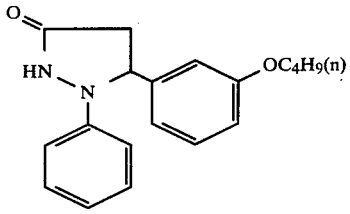

(II-2)

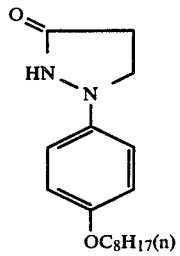

(II-3)

-continued
(II-4)
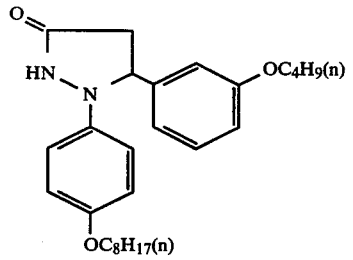
(II-5)
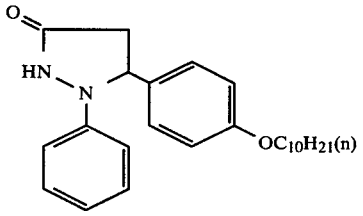
(II-6)
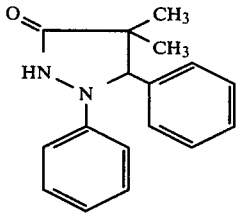
(II-7)
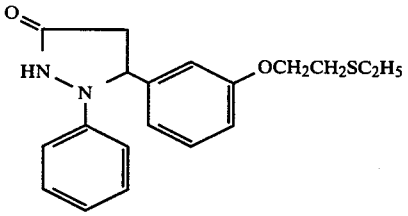
(II-8)
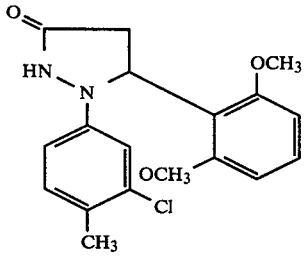
(II-9)
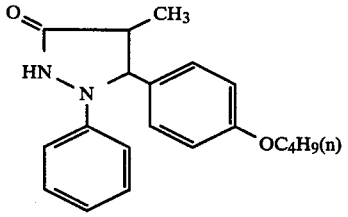
(II-10)
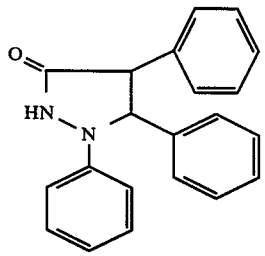
-continued
(II-11)
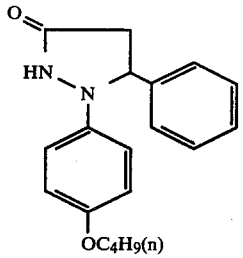
(II-12)
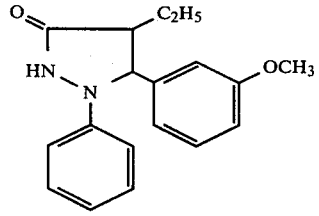
(II-13)
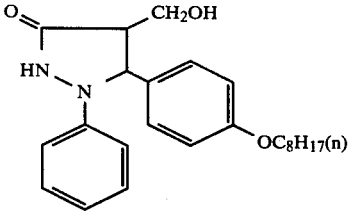
(II-14)
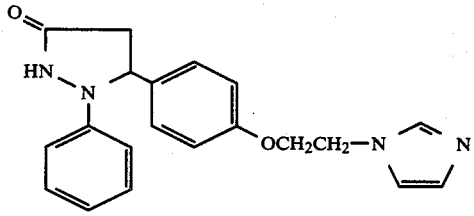
(II-15)
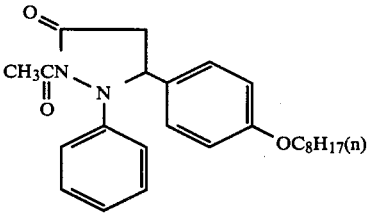
(II-16)
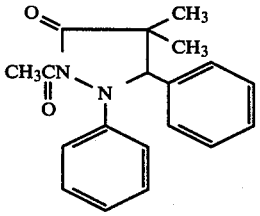
(II-17)
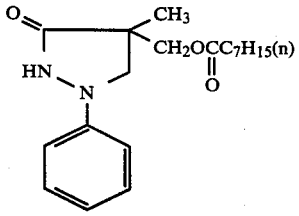

-continued
(II-18)
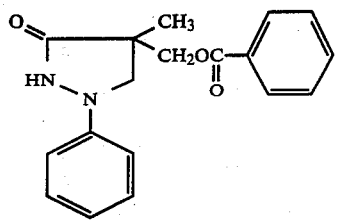
(II-19)
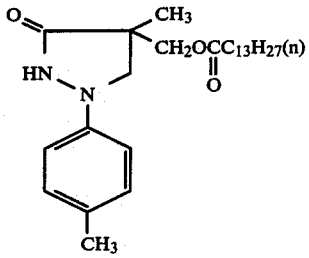
(II-20)
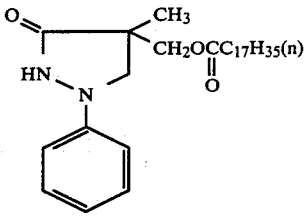
(II-21)
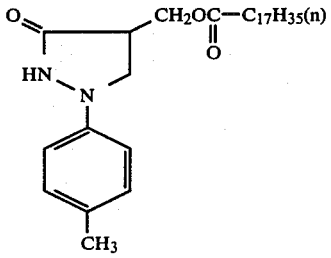
(II-22)
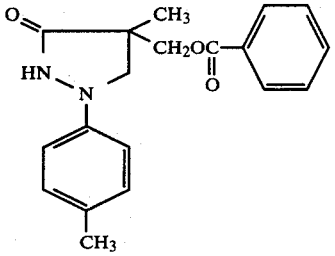
(II-23)
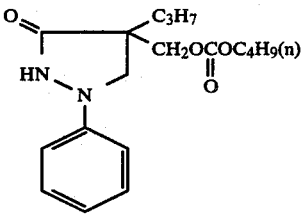
-continued
(II-24)
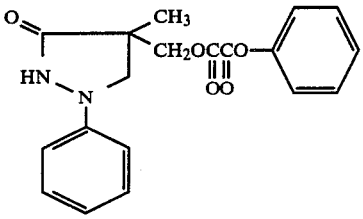
(II-25)
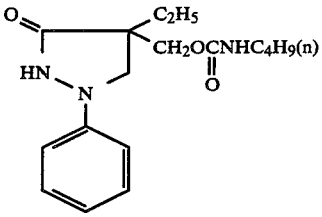
(II-26)
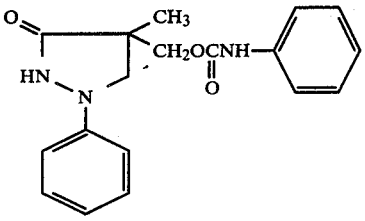
(II-27)
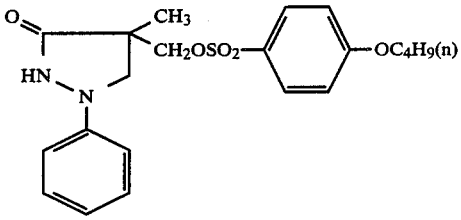
(II-28)
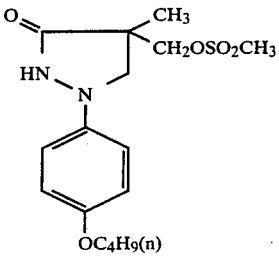
(II-29)
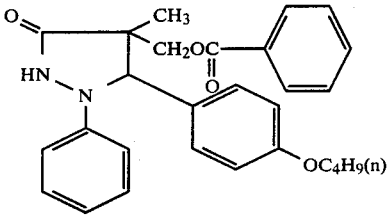
(II-30)
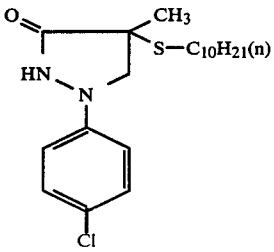

-continued
(II-31)
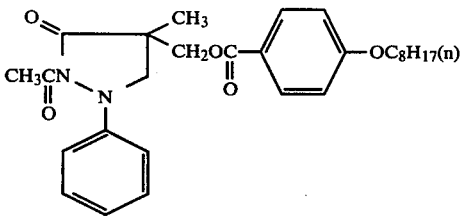
(II-32)
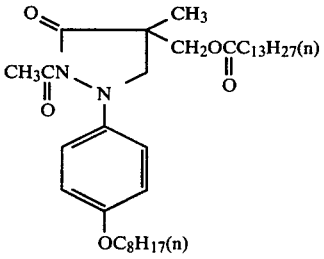
(II-33)
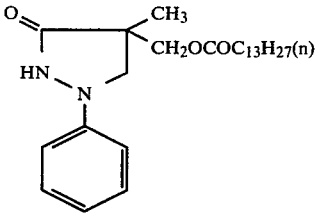
(II-34)
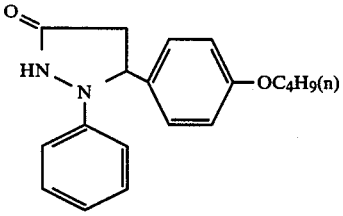
(II-35)
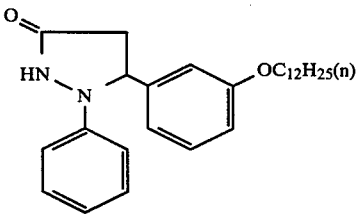
(II-36)
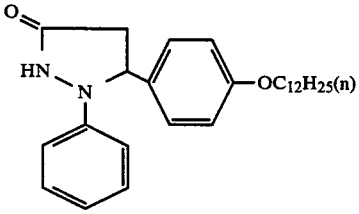
(II-37)
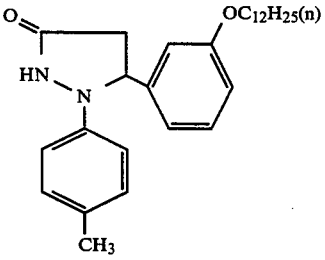
-continued
(II-38)
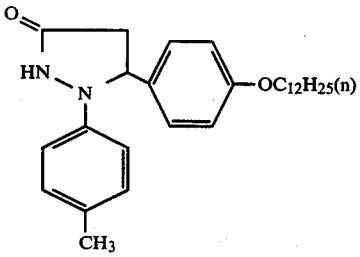
(II-39)
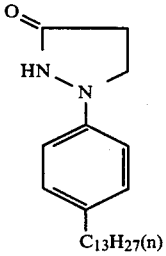
(II-40)
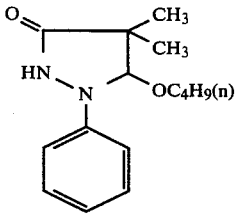
(II-41)
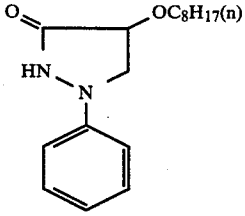
(II-42)
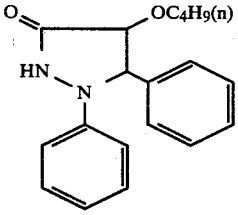
(II-43)
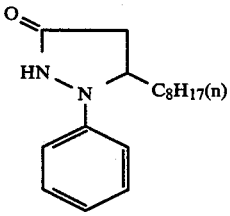
(II-44)
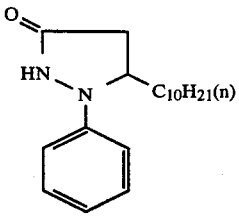

-continued (II-45)

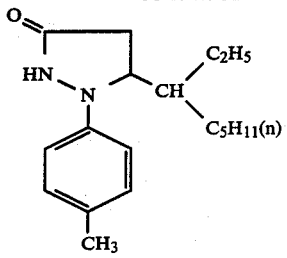

(II-46)

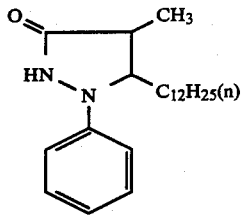

The preferred specific examples of typical couplers according to the present invention include compounds represented by (II-2), (II-4), (II-5), (II-6), (II-8), (II-9), (II-11), (II-12), (II-18), (II-19), (II-20), (II-21), (II-22), (II-34), (II-36), (II-37) and (II-38). The particularly preferred specific examples of typical couplers according to the present invention include compounds represented by (II-2), (II-4), (II-5), (II-6), (II-8), (II-9), (II-11), (II-12), (II-34), (II-36), (II-37) and (II-38).

The 1-aryl-3-pyrazolidone derivatives represented by the general formula (II) are mostly known compounds, which can be easily synthesized with reference to U.S. Pat. Nos. 2,688,024 and 2,704,762 and Japanese Patent Application (OPI) No. 64339/81, and those which are not known can be easily synthesized with reference to Synthesis Examples 1 to 3 described below.

Synthesis examples of the typical compounds represented by the general formula (II) are set forth below.

SYNTHESIS EXAMPLE 1

Synthesis of Compound (II-2)

A mixture solution composed of 9.6 g of phenylhydrazine hydrochloride, 0.5 g of tert-butylhydroquinone, 26.7 ml of methanol containing 28% of sodium methoxide and 250 ml of n-butanol was heated with stirring under nitrogen atmosphere and methanol was distilled off. Then, 20.7 g of methyl m-butoxy cinnamate was added dropwise to the mixture over a period of 1 hour and heated with stirring for 2 hours while distilling off n-butanol at an ambient pressure. The reaction solution was cooled, neutralized with an aqueous hydrochloric acid solution and extracted with ethyl acetate. The extract was washed with water and dried with unhydrous magnesium sulfate. The solvent was distilled off and the residue was crystallized with ethyl acetate and recrystallized from methanol to obtain 13.3 g of Compound (II-2). The melting point was 113° to 116° C.

Elemental Analysis for $C_{19}H_{22}N_2O_2$ Calculated: C: 73.52; H: 7.15; N: 9.02. Found: C: 73.67; H: 7.12; N: 9.00.

SYNTHESIS EXAMPLE 2

Synthesis of Compound (II-3)

A mixture solution composed of 33 g of p-n-octyloxyphenylhydrazine, 1.6 g of 2,5-di-tert-butylhydroquinone, 15 g of powdery sodium methoxide and 300 ml of isopropanol was refluxed by heating under nitrogen atmosphere. To the solution was added dropwise a mixture solution composed of 28 g of ethyl acrylate and 50 ml of isopropanol over a period of 1 hour and further refluxed for 1 hour. The reaction solution was cooled, neutralized with an aqueous hydrochloric acid solution, washed with water and dried with anhydrous magnesium sulfate. The solvent was distilled off and the residue was recrystallized from isopropanol to obtain 6.0 g of Compound (II-3). The melting point was 102° to 105° C.

Elemental Analysis of $C_{17}H_{26}N_2O_2$ Calculated: C: 70.31; H: 9.03; N: 9.64. Found: C: 70.18; H: 9.27; N: 9.69.

SYNTHESIS EXAMPLE 3

Synthesis of Compound (II-33)

A mixture solution composed of 31 g of 4-hydroxymethyl-4-methyl-1-phenylpyrazolidin-3-one, 37 g of myristoyl chloride and 150 ml of acetonitrile was refluxed by heating under nitrogen atmosphere for 8 hours. The reaction solution was allowed to stand overnight at ambient temperature, the crystals thus deposited were collected by filtration and recrystallized from ethanol to obtain 30 g of Compound (II-33). The melting point was 74° to 75.5° C.

Elemental Analysis for $C_{25}H_{40}N_2O_3$ Calculated: C: 72.08; H: 9.68; N: 6.72. Found: C: 71.81; H: 9.78; N: 6.79.

The compound represented by the general formula (II) may be added to any of the hydrophilic colloid layers which is positioned at the remoter side than the silver halide emulsion layer containing the compound represented by the general formula (I) from the support (that is a layer closer than the silver halide emulsion layer toward the surface of the resulting photographic light-sensitive materials). More specifically, an intermediate layer between silver halide emulsion layers, or a silver halide emulsion layer which is a hydrophilic colloid layer and is positioned at the remoter side than the silver halide emulsion layer containing the compound represented by the general formula (I) from the support, or a surface protective layer, etc., is illustrative. It is particularly preferred to add the compound represented by the general formula (II) to an intermediate layer or a protective layer. The intermediate layer or the protective layer may be composed of two or more separate layers.

The hydrophilic colloid layer is mainly composed of gelatin, but other hydrophilic colloids may be used, too. For example, it is possible to use a protein such as a gelatin derivative, a graft polymer of gelatin with other polymers, albumin, or casein; saccharides, including a cellulose derivative such as hydroxyethyl cellulose, carboxymethyl cellulose, cellulose sulfate, etc., sodium alginate, a starch derivative, etc.; and synthetic hydrophilic polymeric substance such as a homopolymer or a copolymer such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

Useful gelatins include lime-processed gelatin as well as acid-processed gelatin and enzyme-processed gelatin, as described in *Bull. Soc. Sci. Phot. Japan,* No. 16, page 30 (1966). Further, a hydrolyzed product and an enzymatic decomposed product of gelatin can be used. Useful gelatin derivatives may be obtained by reacting gelatin with various compounds such as an acid halide, an acid anhydride, an isocyanate, a bromoacetic acid, an alkanesultone, a vinylsulfonamide, a maleinimide compound, a polyalkylene oxide, an epoxy compound, etc. Specific examples thereof are described in U.S. Pat.

Nos. 2,614,928, 3,132,945, 3,186,846 and 3,312,553, British Pat. Nos. 861,414, 1,033,189 and 1,005,784, Japanese Patent Publication No. 26845/67, etc.

As the above-described gelatin graft polymer, it is possible to use those produced by grafting a homopolymer or a copolymer of a vinyl monomer such as acrylic acid, methacrylic acid and a derivative thereof such as an ester or an amide, acrylonitrile, styrene, etc., on gelatin. It is particularly preferred to use a graft polymer of gelatin and a polymer having some degree of compatibility with gelatin, such as a polymer of acrylic acid, methacrylic acid, acrylamide, methacrylamide or hydroxyalkyl methacrylate, etc. Specific examples thereof are described in U.S. Pat. Nos. 2,763,625, 2,831,767, 2,956,884, etc.

Examples of typical synthetic hydrophilic polymeric substances include those described in West German Patent Application (OLS) No. 2,312,708, U.S. Pat. Nos. 3,620,751 and 3,879,205, and Japanese Patent Publication No. 7561/68.

An amount of the compound represented by the general formula (II) to be added to the above-described silver halide emulsion layer and/or hydrophilic colloid layer is preferably from 0.0001 mol to 0.1 mol per $m^2$, and particularly from 0.0005 mol to 0.01 mol per $m^2$, of the photographic light-sensitive material.

An amount of the compound represented by the general formula (I) to be added to the above-described silver halide emulsion layer is preferably from $2\times10^{-3}$ mol to $5\times10^{-1}$ mol, and particularly from $1\times10^{-2}$ mol to $5\times10^{-1}$ mol, per mol of silver in the emulsion layer.

The preferred examples of combination of compound represented by the general formula (I) and compound represented by the general formula (II) include a combination of preferred compounds respectively represented by the general formulae (I) and (II).

The compound represented by the general formula (II) is preferably rather contained in the different layer from that containing the compound represented by the general formula (I) than in the same layer as that containing the compound represented by the general formula (I).

Various methods can be used in order to disperse the compound represented by the general formula (I) and the compound represented by the general formula (II) into hydrophilic colloid layers. For example, they are dispersed in hydrophilic colloids after being dissolved in an organic solvent for photographic additives. Any known organic solvents for photographic additives can be employed. For example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkyl amide (e.g., diethyl laurylamide, etc.), a fatty acid ester (e.g., dibutoxyethyl succinate, dioctyl azelate, etc.), a trimesic acid ester (e.g., tributyl trimesate, etc.), etc., as described in U.S. Pat. No. 2,322,027 are preferably used. Also, those described in U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1031/76, British Pat. No. 1,222,753, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,676,142, 3,700,454, 3,748,141 and 3,837,863, West German Patent Application (OLS) No. 2,538,889, Japanese Patent Application (OPI) Nos. 27921/76, 27922/76, 26035/76, 26036/76 and 62632/75, Japanese Patent Publication No. 29461/74, U.S. Pat. Nos. 3,936,303 and 3,748,141, Japanese Patent Application (OPI) Nos. 1521/78, etc., are preferred. In order to incorporate the magenta coupler and the 1-phenyl-3-pyrazolidone derivative into hydrophilic colloid layers, the method using the above-described organic solvent having a high boiling point as described in U.S. Pat. No. 2,322,027 can be employed, or they are dissolved in an organic solvent having a boiling point of from about 30° to 150° C. such as a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., and then the solution is dispersed in a hydrophilic colloid. The above-described organic solvents having a high boiling point and the above-described organic solvents having a low boiling point may be used as mixtures, if desired.

Furthermore, the dispersing method using a polymeric material as described in Japanese Patent Publication No. 39853/76, Japanese Patent Application (OPI) No. 59943/76 can also be used.

When a coupler having an acid group, such as a carboxylic acid group, a sulfonic acid group, etc., is used, it can be incorporated in a hydrophilic colloid as an alkaline aqueous solution thereof.

The present invention can be applied to a multilayer multicolor photographic light-sensitive material comprising at least two layers having different spectral sensitivities on a support. The multilayer color photographic light-sensitive material generally has at least a red-sensitive emulsion layer, a green-sensitive emulsion layer, and a blue-sensitive emulsion layer on the support. The order of these layers may be suitably varied as occasion demands. Generally, the red-sensitive emulsion layer contains a cyan forming coupler, the green-sensitive emulsion layer contains a magenta forming coupler, and the blue-sensitive emulsion layer contains a yellow forming coupler. However, if desired, other combinations may be utilized.

The color photographic light-sensitive material of the present invention can be applied to any color photographic light-sensitive materials as far as they are subjected to color developing processing, for example, color papers, color negative films, color reversal films, etc.

The color photographic light-sensitive material according to the present invention may contain a yellow coupler, a magenta coupler, and/or a cyan coupler in addition to the magenta coupler represented by the general formula (I).

As a yellow coupler, a benzoylacetanilide compound and a pivaloylacetanilide compound are advantageously used. Specific examples of the yellow couplers capable of use include those described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc.

As a magenta coupler, for example, those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, etc., can be used.

As a cyan coupler, a phenol compound and a naphthol compound can be used. Specific examples thereof include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77, etc.

As a colored coupler, it is possible to use those described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and West German Patent Application (OLS) No. 2,418,959, etc.

As a DIR coupler, it is possible to use those described, for example, in U.S. Pat. Nos. 3,227,554, 3,617,291, 3,701,783, 3,790,384 and 3,632,345, West German Patent Application (OLS) Nos. 2,414,006, 2,454,301 and 2,454,329, British Pat. No. 953,454, Japanese Patent Application (OPI) Nos. 69624/77 and 122335/74 and Japanese Patent Publication No. 16141/76, etc.

In addition to a DIR coupler, the photographic light-sensitive material may contain a compound which releases a development inhibitor at development. For example, those described in U.S. Pat. Nos. 3,297,445 and 3,379,529, West German Patent Application (OLS) No. 2,417,914 and Japanese Patent Application (OPI) Nos. 15271/77 and 9116/78, etc., can be used.

Two or more of the above-described couplers may be contained in the same layer. Two or more layers may contain the same compound.

These couplers are added generally in an amount of from $2\times10^{-3}$ mol to $5\times10^{-1}$ mol, and preferably from $1\times10^{-2}$ mol to $5\times10^{-1}$ mol, per mol of silver in the emulsion layer.

The silver halide emulsion used in the present invention can be prepared by using processes described in P. Glafkides, *Chimie et Physique Photographique* (published by Paul Montel Co., 1967); G. F. Duffin, *Photographic Emulsion Chemistry* (published by The Focal Press, 1966); V. L. Zelikman et al., *Making and Coating Photographic Emulsion* (published by The Focal Press, 1964); etc. Namely, any of an acid process, a neutral process and an ammonia process may be used. Further, a single jet process, a double jet process, or a combination thereof can be used for reacting a soluble silver salt with a soluble halide.

A process for forming particles in the presence of excess silver ion (the so-called reverse mixing process) can be used, too. As one double jet process, it is possible to use a process wherein the liquid phase for forming silver halide is kept at a definite pAg, namely, the so-called controlled double jet process. According to this process, a silver halide emulsion having a regular crystal form and nearly uniform particle size can be obtained.

Two or more silver halide emulsions prepared separately may also be blended.

In the step of formation of silver halide particles or the step of physical ripening, a cadmium salt, a zinc salt, a lead salt, a thallium salt, an iridium salt or a complex salt thereof, a rhodium salt or a complex salt thereof, an iron salt or a complex salt thereof, etc., may be added thereto.

The photographic emulsion used in the present invention may be spectrally sensitized by methine dyes or others. Examples of dyes used include a cyanine dye, a merocyanine dye, a complex cyanine dye, a complex merocyanine dye, a holopolar cyanine dye, a hemicyanine dye, a styryl and a hemioxonol dye. A particularly useful dye is a dye belonging to the classes of a cyanine dye, a merocyanine dye, and a complex merocyanine dye. In these dyes, it is possible to utilize any basic heterocyclic nucleus conventionally utilized for a cyanine dye. Namely, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; the above-described nuclei to which an alicyclic hydrocarbon ring is fused; and the above-described nuclei to which an aromatic hydrocarbon ring is fused, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have substituents on the carbon atoms thereof.

In the merocyanine dye and the complex merocyanine dye, it is possible to utilize, as a nucleus having a ketomethylene structure, a 5- to 6-member heterocyclic nucleus such as a pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, etc.

Examples of useful sensitizing dyes include those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used alone, but a combination of them may be used, too. The combination of the sensitizing dyes is frequently used for the purpose of supersensitization. Typical examples thereof have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110618/77 and 109925/77.

The emulsion may contain a dye which does not have a spectral sensitization function, or a substance showing supersensitization which does not substantially absorb visible rays together with the sensitizing dye. For example, the emulsion may contain an aminostilbene compound substituted with a nitrogen-containing heterocyclic group (for example, those described in U.S. Pat. Nos. 2,933,390 and 3,635,721), an aromatic acid-formaldehyde condensed product (for example, those described in U.S. Pat. No. 3,743,510), a cadmium salt and an azaindene compound. Combinations as described in U.S. Pat. Nos. 3,615,613, 3,615,641, 3,617,295 and 3,635,721 are particularly useful.

For the purpose of increasing sensitivity, increasing contrast, or accelerating development, the photographic emulsion layer of the photographic light-sensitive material of the present invention may contain, for example, polyalkylene oxide or a derivative thereof such as an ether, an ester or an amine, etc., a thioether compound, a thiomorpholine, a quaternary ammonium salt, a urethane derivative, a urea derivative, an imidazole derivative and a 3-pyrazolidone, etc. For example, it is possible to use compounds as described in U.S. Pat. Nos. 2,400,532, 2,423,549, 2,716,062, 3,617,280, 3,772,021 and 3,808,003 and British Pat. No. 1,488,991, etc.

In the photographic light-sensitive material produced according to the present invention, the hydrophilic colloid layer may contain a water-soluble dye as a filter dye or for other purposes such as prevention of irradiation. Examples of such dyes include an oxonol dye, a hemioxonol dye, a styryl dye, a merocyanine dye, a cyanine dye, and an azo dye. Among them, an oxonol dye, a hemioxonol dye and a merocyanine dye are particularly useful. Specific examples of such dyes capable of being used include those described in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In carrying out the present invention, known agents for preventing color fading may be used. Further, such dye image stabilizers in the present invention may be used alone, or two or more of them may be used together. Examples of the known agents for preventing color fading include a hydroquinone derivative as described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc., a gallic acid derivative as described in U.S. Pat. Nos. 3,457,079, 3,069,262, etc., p-alkoxyphenol as described in U.S. Pat. Nos. 2,735,765 and 3,698,909, Japanese Patent Publication Nos. 20977/74 and 6623/77, a p-oxyphenol derivative as described in U.S. Pat. Nos. 3,432,300, 3,573,050, 3,574,627 and 3,764,337 and Japanese Patent Application (OPI) Nos. 35633/77, 147434/77 and 152225/77, and a bisphenol as described in U.S. Pat. No. 3,700,455.

In the photographic light-sensitive material produced according to the present invention, it is preferred that the hydrophilic colloid layer contain an ultraviolet ray absorbing agent. For example, it is possible to use a benzotriazole compound substituted with an aryl group (for example, those described in U.S. Pat. No. 3,533,794), a 4-thiazolidone compound (for example, those described in U.S. Pat. Nos. 3,314,794 and 3,352,681), a benzophenone compound (for example, those described in Japanese Patent Application (OPI) No. 2784/71, a cinnamic acid ester compound (for example, those described in U.S. Pat. Nos. 3,705,805 and 3,707,375), a butadiene compound (for example, those described in U.S. Pat. No. 4,045,229), and a benzoxazole compound (for example, those described in U.S. Pat. No. 3,700,455). Further, it is possible to use those described in U.S. Pat. No. 3,499,762 and Japanese Patent Application (OPI) No. 48535/79. A coupler having an ultraviolet ray absorbing property (for example, an $\alpha$-naphthol type cyan dye forming coupler) and a polymer having an ultraviolet ray absorbing property may be used, too. These ultraviolet ray absorbing agents may be mordanted on a specified layer.

In the photographic light-sensitive material produced according to the present invention, the photographic emulsion layer and other hydrophilic colloid layers may contain a whitening agent such as a stilbene, triazine, oxazole, or coumarin compound. They may be water-soluble. Further, a water-insoluble whitening agent may be used in a dispersed state. Specific examples of the fluorescent whitening agents include those described in U.S. Pat. Nos. 2,632,701, 3,269,840 and 3,359,102, British Pat. Nos. 852,075 and 1,319,763, etc.

The photographic processing of the photographic light-sensitive material of the present invention can be carried out by any known process. Known processing solutions can be used. The processing temperature is selected, generally, from 18° C. to 50° C., but a temperature of lower than 18° C. or higher than 50° C. may be used.

The color developing solution is generally composed of an alkaline aqueous solution containing a color developing agent. As the color developing agent, known primary aromatic amine developing agent can be used, examples of which include a phenylenediamine (for example, 4-amino-N,N-diethylaniline, 3-methyl-4-amino-N,N-diethylaniline, 4-amino-N-ethyl-N-$\beta$-hyroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.).

In addition, those described in L. F. A. Mason, *Photographic Processing Chemistry* (The Focal Press, 1966), pages 226–229, U.S. Pat. Nos. 2,193,015 and 2,592,364, and Japanese Patent Application (OPI) No. 64933/73 may be used.

The color developing solution may contain a pH buffer agent such as a sulfite, a carbonate, a borate or a phosphate of an alkali metal, and a development restrainer or an antifogging agent such as a bromide, an iodide, an organic antifogging agent, etc. If necessary, it may contain a water softener, a preservative such as hydroxylamine, an organic solvent such as benzyl alcohol or diethylene glycol, a development accelerator such as polyethylene glycol, a quaternary ammonium salt or an amine, a dye forming coupler, a competitive coupler, a fogging agent such as sodium borohydride, an auxiliary developing agent such as 1-phenyl-3-pyrazolidone, a thickener, a polycarboxylic acid type chelating agent as described in U.S. Pat. No. 4,083,723, and an antioxidant as described in West German Patent Application (OLS) No. 2,622,950, etc.

In the present invention, the color photographic light-sensitive material may contain a color developing agent. The color developing agent can be incorporated as a precursor or a complex salt as described in U.S. Pat. Nos. 2,478,400, 3,342,597, 3,342,599, 3,719,492 and 4,214,047, Japanese Patent Application (OPI) Nos. 135628/78, 79035/79, 6235/81, 54430/81 and 89735/81, *Research Disclosure*, No. 13924, No. 14850 and No. 15159, etc. In such a case, it is possible to treat the color photographic light-sensitive material with an alkaline bath instead of a color developing bath.

After carrying out the color development or the alkaline treatment, the photographic emulsion layers are generally subjected to bleaching. The bleaching may be carried out simultaneously with fixing or may be carried out separately. As the bleaching agent, a compound of a polyvalent metal such as iron (III), cobalt (III), chromium (VI) or copper (II), etc., a peracid, a quinone, a nitroso compound, etc., can be used. For example, it is possible to use a ferricyanide, a bichromate, and an organic complex salt of iron (III) or cobalt (III), for example, a complex salt of an aminopolycarboxylic acid such as ethylenediaminetetraacetic acid, nitrilotriacetic acid or 1,3-diamino-2-propanol tetraacetic acid, etc., or an organic acid such as citric acid, tartaric acid, malic acid, etc.; a persulfate; a permanganate; nitrosophenol; etc. Among them, potassium ferricyanide, (ethylenediaminetetraacetato)iron (III) sodium complex and (ethylenediaminetetraacetato)iron (III) ammonium complex are particularly useful. (Ethylenediaminetetraacetato)iron (III) complexes are useful for both a bleaching solution and a mono-bath bleach-fixing solution.

To the bleaching solution or the bleach-fixing solution, it is possible to add a bleaching accelerator as described in U.S. Pat. Nos. 3,042,520 and 3,241,966, and Japanese Patent Publication Nos. 8506/70 and 8836/70 or a thiol compound as described in Japanese Patent Application (OPI) No. 65732/78, and various other additives.

The photographic light-sensitive material according to the present invention may be processed with the developing solution supplemented or controlled by the methods as described in Japanese Patent Application (OPI) Nos. 84636/76, 119934/77, 46732/78, 9626/79, 19741/79, 37731/79, 1048/81, 1049/81 and 27142/81, etc.

The bleach-fixing solution used for processing the photographic light-sensitive material according to the present invention may be that which is regenerated by the methods as described in Japanese Patent Application (OPI) Nos. 781/71, 46437/73, 18191/73, 145231/75, 18541/76, 19535/76 and 144620/76 and Japanese Patent Publication No. 23178/76, etc.

The present invention is illustrated in greater detail by reference to the following examples, but the present invention is not to be construed as being limited thereto.

EXAMPLE 1

A multilayer color negative light-sensitive material composed of layers having the following compositions provided on a cellulose triacetate film support was prepared.

Layer 1: Antihalation layer:

40 cc of a 5% by weight aqueous solution of a coating aid, sodium p-dodecylbenzenesulfonate, was added to 1 kg of a black colloidal silver emulsion (containing 15 g of blacked silver and 100 g of gelatin in 1 kg of the emulsion), and the mixture was coated at a dry thickness of 2μ.

Layer 2: Gelatin intermediate layer (dry thickness: 1.0μ)

Layer 3: Red-sensitive low-speed silver halide emulsion layer:

A silver iodobromide emulsion containing 5 mol% of iodide (average particle size: 0.3μ, containing 100 g of silver halide and 70 g of gelatin in 1 kg of the emulsion) was prepared by a conventional method. To 1 kg of this emulsion, 210 cc of a 0.1% methanol solution of anhydro-5,5-dichloro-9-ethyl-3,3'-di(3-sulfopropyl)thiacarbocyanine hydroxide pyridinium salt was added as a red-sensitive spectral sensitizing dye, and then 20 cc of a 5% by weight aqueous solution of 5-methyl-7-hydroxy-2,3,4-triazaindolizine and 400 g of a cyan coupler emulsion (1) and 200 g of an emulsion (2) having the compositions described below were added. Thereafter, 200 cc of a 2% aqueous solution of a colored cyan coupler (CC-1) described below was added and 30 cc of a 2% by weight aqueous solution of 2-hydroxy-4,6-dichlorotriazine sodium salt as a gelatin hardener was added thereto to prepare a red-sensitive low-speed silver halide emulsion. The coating solution thus obtained was coated at a dry thickness of 3.5μ.

CC-1

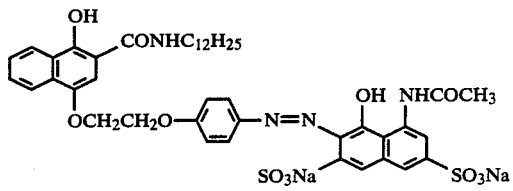

Emulsion (1)

| | | |
|---|---|---|
| (1) | 10% by weight aqueous gelatin solution | 1,000 g |
| (2) | Sodium p-dodecylbenzenesulfonate | 5 g |
| | Tricresyl phosphate | 60 cc |
| | Cyan coupler (C-101) | 70 g |
| | Ethyl acetate | 100 cc |

After the mixture (2) was dissolved by heating at 55° C., it was added to (1) previously heated at 55° C., and the resulting mixture was emulsified by a colloid mill.

C-101

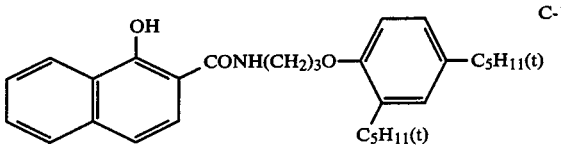

Emulsion (2)

| | | |
|---|---|---|
| (1) | 10% by weight aqueous gelatin solution | 1,000 g |
| (2) | Sodium p-dodecylbenzenesulfonate | 5 g |
| | Tricresyl phosphate | 60 cc |
| | Cyan coupler (C-101) | 70 g |
| | DIR compound (D-1) | 10 g |
| | Ethyl acetate | 100 cc |

After the mixture (2) was dissolved by heating at 55° C., it was added to (1) previously heated at 55° C., and the resulting mixture was emulsified by a colloid mill.

D-1

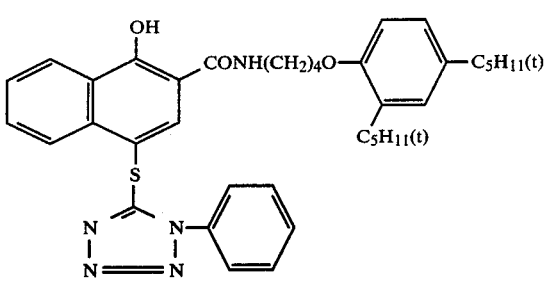

Layer 4: Red-sensitive high-speed silver halide emulsion layer:

In the silver halide emulsion for Layer 3, the following modification was carried out.

| | |
|---|---|
| Average particle size of the emulsion | 0.9 μ |
| Amount of the red-sensitive spectral sensitizing dye added | 140 cc |
| Emulsion (1) | 220 g |
| Emulsion (2) | 30 g |

The resulting silver halide coating solution was coated at a dry thickness of 2.2μ.

Layer 5: Gelatin intermediate layer (dry thickness: 0.8μ)

Layer 6: Green-sensitive low-speed silver halide emulsion layer:

To 1 kg of a silver iodobromide emulsion used in Layer 3, 180 cc of a 0.1% methanol solution of 3,3'-di(2-sulfoethyl)-9-ethylbenzoxacarbocyanine pyridinium salt, as a green-sensitive spectral sensitizing dye, and 20 cc of a 5% by weight aqueous solution of 5-methyl-7-hydroxy-2,3,4-triazaindolizine were added in order, and thereafter 320 g of a magenta coupler emulsion (3) and 180 g of an emulsion (4) having the compositions described below were added thereto. Further, 50 cc of a 2% by weight aqueous solution of 2-hydroxy-4,6-dichlorotriazine sodium salt was added as a gelatin hardener to prepare a green-sensitive low-speed silver halide emulsion. The coating solution thus obtained was coated at a dry thickness of 3.2μ.

Layer 7: Green-sensitive high-speed silver halide emulsion layer:

In the silver halide emulsion layer for Layer 6, the following modification was carried out.

| | |
|---|---|
| Average particle size of the emulsion | 1.0 μ |
| Iodide content of the emulsion | 6.5 mol % |
| Amount of the green-sensitive spectral sensitizing dye added | 100 cc |
| Emulsion (3) | 150 g |
| Emulsion (4) | 30 g |

The resulting silver halide coating solution was coated at a dry thickness of 2.2μ.

Emulsion (3)

| | |
|---|---|
| (1) 10% by weight aqueous gelatin solution | 1,000 g |
| (2) Sodium p-dodecylbenzenesulfonate | 5 g |
| Tricresyl phosphate | 80 cc |
| Magenta coupler (I-2) | 50 g |
| Colored magenta coupler (CM-1) | 10 g |
| Ethyl acetate | 120 cc |

After the mixture of (2) was dissolved by heating at 55° C., it was added to (1) previously heated at 55° C., and the resulting mixture was emulsified by a colloid mill.

CM-1

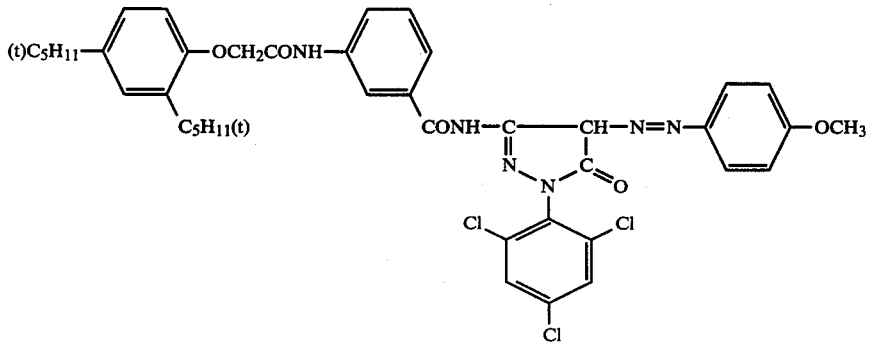

Emulsion (4)

| | |
|---|---|
| (1) 10% by weight aqueous gelatin solution | 1,000 g |
| (2) Sodium p-dodecylbenzenesulfonate | 5 g |
| Tricresyl phosphate | 80 cc |
| Magenta coupler (I-2) | 50 g |
| Colored magenta coupler (CM-1) | 10 g |
| DIR compound (D-2) | 15 g |
| Ethyl acetate | 120 cc |

After the mixture (2) was dissolved by heating at 55° C., it was added to (1) previously heated at 55° C., and the resulting mixture was emulsified by a colloid mill.

D-2

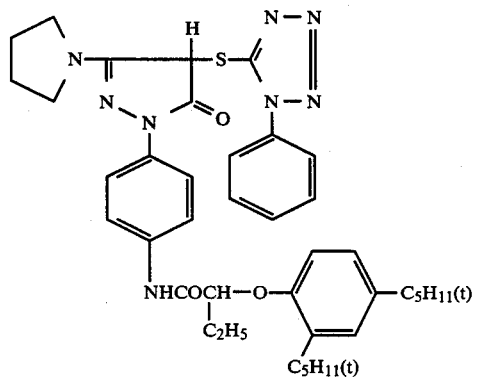

Layer 8: Yellow colloidal silver layer (dry thickness: 1.6μ)

Layer 9: Blue-sensitive low-speed silver halide emulsion layer:

To 1 kg of a silver iodobromide emulsion same as that used in Layer 3 except that the average particle size was 0.5μ, 20 cc of a 5% by weight aqueous solution of 5-methyl-7-hydroxy-2,3,4-triazaindolizine and 1,500 g of a yellow coupler emulsion (5) having the composition described below were added. Further, 50 cc of a 2% by weight aqueous solution of 2-hydroxy-4,6-dichlorotriazine sodium salt was added as a gelatin hardener to prepare a blue-sensitive low-speed silver halide emulsion.

The coating solution thus obtained was coated at a dry thickness of 3.0μ.

Emulsion (5)

| | |
|---|---|
| (1) 10% by weight aqueous gelatin solution | 1,000 g |
| (2) Sodium p-dodecylbenzenesulfonate | 5 g |

-continued

| | |
|---|---|
| Tricresyl phosphate | 80 cc |
| Yellow coupler (Y-101) | 100 g |
| Ethyl acetate | 120 cc |

After the mixture (2) was dissolved by heating at 55° C., it was added to (1) previously heated at 55° C., and the resulting mixture was emulsified by a colloid mill.

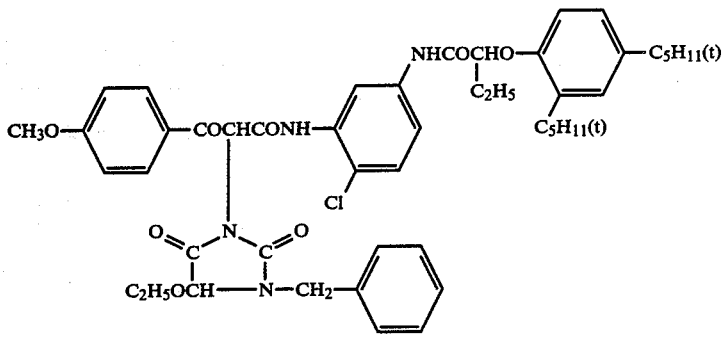

Y-1

Layer 10: Blue-sensitive high-speed silver halide emulsion layer:

In the silver halide emulsion for Layer 9, the following modification was carried out.

| | |
|---|---|
| Average particle size of the emulsion | 1.1 μ |
| Emulsion (5) | 300 g |

The resulting silver halide coating solution was coated at a dry thickness of 2.5μ.

Layer 11: Gelatin protective layer (dry thickness: 1.5μ)

The photographic light-sensitive material thus prepared was designated Sample A.

In a manner similar to the above-described Sample A, Samples B to I were prepared in which the compounds represented by the general formula (II) and the comparison compounds were incorporated into the specific layer as shown in Table 1 below.

These Samples A to I were exposed to light through an optical wedge and then subjected to the following processing steps:

| Processing Step | Temperature (°C.) | Time |
|---|---|---|
| 1. Color Development | 38 | 3 min 15 sec |
| 2. Bleaching | " | 6 min 30 sec |
| 3. Washing with Water | " | 2 min |
| 4. Fixing | " | 4 min |
| 5. Washing with Water | " | 4 min |
| 6. Stabilizing Bath | " | 1 min |

The processing solutions used had the following compositions:

Color Developing Solution

| | |
|---|---|
| 4-Amino-N—ethyl-N—(β-methanesulfonamidoethyl)aniline Monosulfate | 5 g |
| Sodium Sulfite | 5 g |
| Hydroxylamine Sulfate | 2 g |
| Potassium Carbonate | 30 g |
| Potassium Hydrogen Carbonate | 1.2 g |
| Potassium Bromide | 1.2 g |
| Sodium Chloride | 0.2 g |
| Trisodium Nitrilotriacetate | 1.2 g |

-continued

| | |
|---|---|
| Adjust pH to 10.1 | |
| Water to make | 1,000 ml |

Bleaching Solution

| | |
|---|---|
| Iron (III) Ammonium Ethylenediamine-tetraacetate | 100 g |
| Disodium Ethylenediaminetetraacetate | 10 g |
| Potassium Bromide | 150 g |
| Glacial Acetic Acid | 10 g |
| Aqueous Ammonia to adjust pH to 6.0 | |
| Water to make | 1,000 ml |

Fixing Solution

| | |
|---|---|
| Ammonium Thiosulfate | 150 g |
| Sodium Sulfite | 10 g |
| Sodium Hydrogen Sulfite | 2.5 g |
| Adjust pH to 6.0 | |
| Water to make | 1,000 ml |

Stabilizing Bath

| | |
|---|---|
| Formalin (37%) | 2 ml |
| Fuji Drywell | 3 ml |
| Water to make | 1,000 ml |

The optical density of the samples thus processed was measured using green light. Stain density was obtained. The results thus obtained are shown in Table 1 below.

TABLE 1

| Sample | Compound Incorporated | Amount Incorporated (mg/m²) | Layer Incorporated | Stain Density |
|---|---|---|---|---|
| A (Comparison) | — | — | — | 0.76 |
| B (Comparison) | 1-Phenyl-3-pyrazolidone | 80 | Layer 11 | 0.72 |
| C (Comparison) | 4-Methyl-4-hydroxymethyl-3-pyrazolidone | 100 | Layer 11 | 0.74 |
| D (Present Invention) | (II-19) | 215 | Layer 11 | 0.50 |
| E (Present Invention) | (II-19) | 215 | Layer 8 | 0.50 |
| F (Comparison) | (II-19) | 215 | Layer 5 | 0.74 |
| G (Present Invention) | (II-35) | 210 | Layer 11 | 0.49 |

TABLE 1-continued

| Sample | Compound Incorporated | Amount Incorporated ($mg/m^2$) | Layer Incorporated | Stain Density |
|---|---|---|---|---|
| H (Present Invention) | (II-35) | 210 | Layer 8 | 0.49 |
| I (Comparison) | (II-35) | 210 | Layer 5 | 0.73 |

From the results as shown in Table 1 above, it is understood that the magenta stain density is remarkably reduced with Samples D, E, G and H according to the present invention. On the contrary, when the compound represented by the general formula (II) was incorporated into a closer layer than a layer containing the magenta coupler to the support (i.e., Layer 1 to Layer 5), the effect obtained was very small (see Samples F and I). Further, the stain density was hardly reduced by incorporation of the comparison compound into the layer.

EXAMPLE 2

A multilayer light-sensitive material for color paper composed of layers having the following compositions provided on a paper support laminated with polyethylene was prepared.

Layer 1: Blue-sensitive silver halide emulsion layer:

A mixture prepared by dispersing a yellow coupler (Y-102) dissolved in dioctyl butyl phosphate in a silver chlorobromide emulsion (silver bromide: 80 mol%) was coated in the amount as follows:

| | |
|---|---|
| Silver: | 0.4 $g/m^2$ |
| Coupler: | $8 \times 10^{-4}$ $mol/m^2$ |
| Oil: | 0.3 $g/m^2$ |

Layer 2: Gelatin intermediate layer:

| | |
|---|---|
| Gelatin: | 1 $g/m^2$ |

Layer 3: Green-sensitive silver halide emulsion layer:

A mixture prepared by dispersing a magenta coupler (I-5) according to the present invention dissolved in tricresyl phosphate in a silver chlorobromide emulsion (silver bromide: 60 mol%) was coated in the amount as follows:

| | |
|---|---|
| Silver: | 0.23 $g/m^2$ |
| Coupler: | $5.8 \times 10^{-4}$ $mol/m^2$ |
| Oil: | 0.35 $g/m^2$ |

Layer 4: Gelatin intermediate layer:

A mixture prepared by dispersing 2-(2-hydroxy-3-sec-butyl-5-tert-butylphenyl)benzotriazole dissolved in dibutyl phthalate was coated in the amount as follows:

| | |
|---|---|
| Oil: | 0.25 $g/m^2$ |
| Benzotriazole: | 1.0 $g/m^2$ |

Layer 5: Red-sensitive silver halide emulsion layer:

A mixture prepared by dispersing a cyan coupler (C-102) dissolved in dibutyl phthalate in a silver chlorobromide emulsion (silver bromide: 50 mol%) was coated in the amount as follows:

| | |
|---|---|
| Silver: | 0.3 $g/m^2$ |
| Coupler: | $8.5 \times 10^{-4}$ $mol/m^2$ |
| Oil: | 0.2 $g/m^2$ |

Layer 6: Gelatin protective layer:

| | |
|---|---|
| Gelatin: | 1 $g/m^2$ |

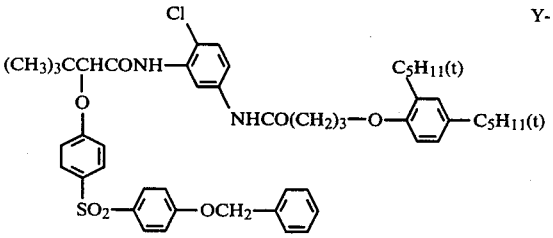

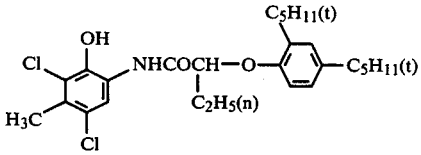

The sample thus prepared was designated Sample J.

In a manner similar to the above-described Sample J, Samples K to R were prepared in which the compounds represented by the general formula (II) and the comparison compounds were incorporated into the specific layer as shown in Table 2 below.

These Samples J to R were exposed to light through an optical wedge and then subjected to the following processing steps:

| Processing Step (33° C.) | Time |
|---|---|
| Color Development | 3 min 30 sec |
| Bleach-Fixing | 1 min 30 sec |
| Washing with Water | 2 min |
| Drying | 10 min |

The composition of each processing solution is set forth below:

Color Developing Solution

| | |
|---|---|
| Benzyl Alcohol | 10 ml |
| Diethylene Glycol | 3 ml |
| Potassium Carbonate | 25 g |
| Sodium Chloride | 0.1 g |
| Sodium Bromide | 0.5 g |
| Anhydrous Sodium Sulfite | 2 g |
| Hydroxylamine Sulfate | 2 g |
| N—Ethyl-N—β-methanesulfonamidoethyl-3-methyl-4-aminoaniline Sulfate | 4 g |
| Water to make | 1 l |
| Sodium hydroxide (NaOH) was added to adjust pH to 10. | |

Bleach-Fixing Solution

| | |
|---|---|
| Ammonium Thiosulfate | 124.5 g |
| Sodium Metabisulfite | 13.3 g |

-continued

| | |
|---|---|
| Anhydrous Sodium Sulfite | 2.7 g |
| Iron (III) Ammonium Ethylenediamine tetraacetate | 65 g |
| Adjust pH to 6.7 to 6.8 | |
| Water to make | 1 l |

The magenta stain density of the Samples J to R thus processed was measured using a Macbeth densitometer. The results thus obtained are shown in Table 2 below.

TABLE 2

| Sample | Compound Incorporated | Amount Incorporated ($mg/m^2$) | Layer Incorporated | Magenta Stain Density |
|---|---|---|---|---|
| J (Comparison) | — | — | — | 0.25 |
| K (Comparison) | 1-Phenyl-3-pyrazolidone | 80 | Layer 6 | 0.22 |
| L (Comparison) | 1-Phenyl-4,4-dimethyl-3-pyrazolidone | 95 | Layer 6 | 0.23 |
| M (Present Invention) | (II-18) | 145 | Layer 4 | 0.16 |
| N (Present Invention) | (II-18) | 145 | Layer 6 | 0.15 |
| O (Comparison) | (II-18) | 145 | Layer 2 | 0.23 |
| P (Present Invention) | (II-36) | 210 | Layer 6 | 0.15 |
| Q (Present Invention) | (II-36) | 210 | Layer 3 | 0.14 |
| R (Comparison) | (II-36) | 210 | Layer 2 | 0.23 |

From the results as shown in Table 2 above, it is understood that the magenta stain density is remarkably reduced with Samples M, N, P and Q according to the present invention. On the contrary, when the same compounds were incorporated into Layer 2 as in Samples O and R, the magenta stain density was hardly reduced. Further, when the comparison compounds were used, the effect for reducing magenta stain was insufficient even if they were incorporated into Layer 6. In addition, the gradation of the green-sensitive layer and the red-sensitive layer became soft and color turbidity occurred. Therefore, satisfactory photographic properties could not be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer containing a compound represented by the following general formula (I):

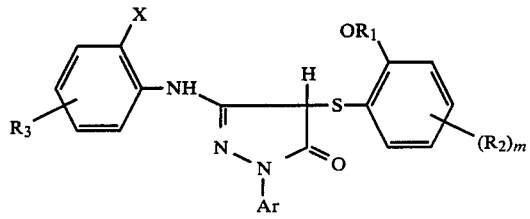

(I)

wherein $R_1$ represents an alkyl group or an aryl group; $R_2$ represents hydrogen, a hydroxy group, a halogen atom, an alkyl group, an alkoxy group or an aryl group; $R_3$ represents hydrogen, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, an alkylureido group, an acyl group, a nitro group, a carboxy group, or a trichloromethyl group; X represents a halogen atom or an alkoxy group; Ar represents a substituted phenyl group; and m represents an integer of from 1 to 4; said silver halide color photographic light-sensitive material comprises a compound represented by the following general formula (II) in the silver halide emulsion layer containing the compound represented by the above general formula (I) and/or a hydrophilic colloid layer which is positioned at the remoter side than the silver halide emulsion layer from the support:

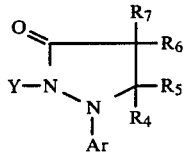

(II)

wherein Ar represents a phenyl group; Y represents hydrogen or an acyl group; $R_4$, $R_5$, $R_6$ and $R_7$, which may be the same or different, each represents an alkyl group, an alkoxy group, an aryl gorup, an alkylthio group or an arylthio group; and the total number of carbon atoms included in the substituents represented by $R_4$, $R_5$, $R_6$ and $R_7$ and the substituents on the phenyl group represented by Ar is not less than 6.

2. A silver halide color photographic light-sensitive material as claimed in claim 1, wherein the substituent for the substituted phenyl group represented by Ar in the general formula (I) is a halogen atom, an alkyl group having from 1 to 22 carbon atoms, an alkoxy group having from 1 to 22 carbon atoms, an alkoxycarbonyl group having from 2 to 23 carbon atoms or a cyano group.

3. A silver halide color photographic light-sensitive material as claimed in claim 1, wherein the alkoxy group represented by X is an alkoxy group having from 1 to 22 carbon atoms.

4. A silver halide color photographic light-sensitive material as claimed in claim 1, wherein the group represented by $R_3$ includes an alkyl moiety having from 1 to 36 carbon atoms.

5. A silver halide color photographic light-sensitive material as claimed in claim 1, wherein the group represented by $R_3$ includes an aryl moiety having from 6 to 38 carbon atoms.

6. A silver halide color photographic light-sensitive material as claimed in claim 1, wherein the alkyl group represented by $R_1$ is an alkyl group having from 1 to 22 carbon atoms.

7. A silver halide color photographic light-sensitive material as claimed in claim 1, wherein the total number of carbon atoms included in the groups represented by $R_1$ and $R_2$ is not less than 6.

8. A silver halide color photographic light-sensitive material as claimed in claim 1, wherein the phenyl group represented by Ar in the general formula (II) is a substituted phenyl group.

9. A silver halide color photographic light-sensitive material as claimed in claim 8, wherein the substituent for the substituted phenyl group represented by Ar is a halogen atom, an amino group, a nitro group, an alkyl group, an alkoxy group, or a carboxy group.

10. A silver halide color photographic light-sensitive material as claimed in claim 1, wherein Ar in the general formula (II) is an unsubstituted phenyl group, an alkyl-substituted phenyl group or an alkoxy-substituted phenyl group.

11. A silver halide color photographic light-sensitive material as claimed in claim 1, wherein the acyl group represented by Y is an acyl group having from 1 to 5 carbon atoms.

12. A silver halide color photographic light-sensitive material as claimed in claim 1, wherein Y is a hydrogen atom or an acetyl group.

13. A silver halide color photographic light-sensitive material as claimed in claim 1, wherein the alkyl group represented by $R_4$, $R_5$, $R_6$ or $R_7$ is an alkyl group having from 1 to 20 carbon atoms.

14. A silver halide color photographic light-sensitive material as claimed in claim 1, wherein the alkoxy group represented by $R_4$, $R_5$, $R_6$ or $R_7$ is an alkoxy group having from 1 to 20 carbon atoms.

15. A silver halide color photographic light-sensitive material as claimed in claim 1, wherein the alkylthio group represented by $R_4$, $R_5$, $R_6$ or $R_7$ is an alkylthio group having from 1 to 20 carbon atoms.

16. A silver halide color photographic light-sensitive material as claimed in claim 1, wherein the aryl group represented by $R_4$, $R_5$, $R_6$ or $R_7$ is an aryl group having from 6 to 18 carbon atoms.

17. A silver halide color photographic light-sensitive material as claimed in claim 1, wherein the arylthio group represented by $R_4$, $R_5$, $R_6$ or $R_7$ is an arylthio group having from 6 to 18 carbon atoms.

18. A silver halide color photographic light-sensitive material as claimed in claim 1, wherein the total number of carbon atoms included in the substituents represented by $R_4$, $R_5$, $R_6$ and $R_7$ and the substituents on the phenyl group represented by Ar in the general formula (II) is from 6 to 50.

19. A silver halide color photographic light-sensitive material as claimed in claim 1, wherein the hydrophilic colloid layer containing the compound represented by the general formula (II) is an intermediate layer or a protective layer.

20. A silver halide color photographic light-sensitive material as claimed in claim 1, wherein a hydrophilic colloid in the hydrophilic colloid layer is gelatin.

21. A silver halide color photographic light-sensitive material as claimed in claim 1, wherein the compound represented by the general formula (II) is present in an amount of from 0.0001 mol to 0.1 mol per $m^2$ of the photographic light-sensitive material.

22. A silver halide color photographic light-sensitive material as claimed in claim 1, wherein the silver halide emulsion layer is a green-sensitive silver halide emulsion layer.

23. A method of forming a color image comprising developing an imagewise exposed silver halide color photographic light-sensitive material comprising a support having thereon a silver halide emulsion layer containing a compound represented by the following general formula (I):

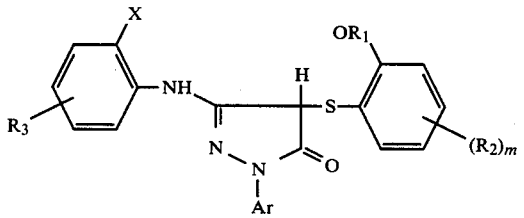

(I)

wherein $R_1$ represents an alkyl group or an aryl group; $R_2$ represents hydrogen, a hydroxy group, a halogen atom, an alkyl group, an alkoxy group or an aryl group; $R_3$ represents hydrogen, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, an alkylureido group, an acyl group, a nitro group, a carboxy group, or a trichloromethyl group; X represents a halogen atom or an alkoxy group; Ar represents a substituted phenyl group; and m represents an integer of from 1 to 4; said silver halide color photographic light-sensitive material comprises a compound represented by the following general formula (II) in the silver halide emulsion layer containing the compound represented by the above general formula (I) and/or a hydrophilic colloid layer which is positioned at the remoter side than the silver halide emulsion layer from the support:

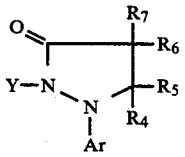

(II)

wherein Ar represents a phenyl group; Y represents hydrogen or an acyl group; $R_4$, $R_5$, $R_6$ and $R_7$, which may be the same or different, each represents an alkyl group, an alkoxy group, an aryl group, an alkylthio group or an arylthio group; and the total number of carbon atoms included in the substituents represented by $R_4$, $R_5$, $R_6$ and $R_7$ and the substituents on the phenyl group represented by Ar is not less than 6, with an aqueous alkaline solution containing a color developing agent.

* * * * *